US008597047B2

(12) United States Patent
Soubh et al.

(10) Patent No.: US 8,597,047 B2
(45) Date of Patent: Dec. 3, 2013

(54) INSULATOR WITH AIR DIELECTRIC CAVITIES FOR ELECTRICAL CONNECTOR

(75) Inventors: Emad Soubh, Camas, WA (US); Kevin Traugott, Georgetown, TX (US)

(73) Assignee: AirBorn, Inc., Georgetown, TX (US)

( * ) Notice: Subject to any disclaimer, the term of this patent is extended or adjusted under 35 U.S.C. 154(b) by 91 days.

(21) Appl. No.: 13/296,174

(22) Filed: Nov. 14, 2011

(65) Prior Publication Data

US 2013/0122743 A1 May 16, 2013

(51) Int. Cl.
*H01R 13/00* (2006.01)

(52) U.S. Cl.
USPC ..... 439/485; 439/941

(58) Field of Classification Search
USPC ..... 439/485, 206, 941
See application file for complete search history.

(56) References Cited

U.S. PATENT DOCUMENTS 4,718,864 A * 1/1988 Flanagan ..... 439/578
5,527,189 A * 6/1996 Middlehurst et al. .... 439/607.14
6,077,115 A * 6/2000 Yang et al. ..... 439/567
6,663,428 B1 * 12/2003 Wu ..... 439/607.08
6,814,590 B2 11/2004 Minich et al.
7,303,427 B2 12/2007 Swain
7,513,787 B2 * 4/2009 AbuGhazaleh et al. ..... 439/344
7,666,025 B2 * 2/2010 Cheng et al. ..... 439/485
7,726,982 B2 6/2010 Ngo
7,914,305 B2 * 3/2011 Amleshi et al. ..... 439/101
8,109,770 B2 * 2/2012 Perugini et al. ..... 439/74
2007/0293084 A1 12/2007 Ngo
2009/0253298 A1 * 10/2009 Kameyama et al. ..... 439/607.41
2010/0022141 A1 * 1/2010 Wen ..... 439/676
2010/0255727 A1 * 10/2010 He et al. ..... 439/607.3
2010/0267281 A1 * 10/2010 Li ..... 439/607.01
2010/0273347 A1 * 10/2010 Tai et al. ..... 439/485
2010/0330846 A1 12/2010 Ngo et al.

* cited by examiner

*Primary Examiner* — Neil Abrams
*Assistant Examiner* — Phuongchi T Nguyen
(74) *Attorney, Agent, or Firm* — Locke Lord LLP

(57) ABSTRACT

An insulator for an electrical connector that comprises a back shell, metal shell, EMI band, and the insulator. The insulator features alternating contact cavities and air dielectric cavities. The air dielectric cavities reduce the effective dielectric constant of the connector, which allows high-speed data to be transmitted while maintaining impedance, thereby preserving signal fidelity.

18 Claims, 7 Drawing Sheets

INSULATOR WITH AIR DIELECTRIC CAVITIES FOR ELECTRICAL CONNECTOR

BACKGROUND OF THE INVENTION

1. Field of Invention

The present invention is directed to an insulator for an electrical connector having air cavities between contact cavities to reduce the effective dielectric constant of the material used to construct the insulator, which allows for a tighter contact pitch.

2. Description of Related Art

Prior connectors have featured air channels or passages. Connectors with air channels or passages are mentioned, for example, in U.S. Pat. No. 6,814,590; U.S. Pat. No. 7,303,427; U.S. 2007/0293084; and U.S. 2010/0330846. In contrast to the air cavities of the present invention, however, the air channels or passages in other connectors perform a completely different function. In these other connectors, the connector contacts are intended to carry a high current, not high-speed digital data. In connectors that carry a high current, the purpose of the air channels is to allow airflow within the connector for the purposes of dissipating the heat that is generated by the high current flowing through the resistance of the contacts. This heating is commonly referred to as "$I^2R$" heating because the power generated in the contact is equal to the current squared times the resistance of the contact. In many such connectors, the characteristic impedance between adjacent contacts is not a design consideration at all.

While other connectors have used air cavities, those applications were primarily directed to high-current connectors that needed the air cavities to dissipate heat. In other applications concerning power distribution systems, a higher effective dielectric constant is desirable to reduce impedance to minimize voltage drops. In some traditional applications, reducing impedance and increasing the relative dielectric constant is a design consideration for the following reason. If the power contacts are intended to supply DC power to integrated circuits ("IC") that are switching high currents at high speeds, which is common in large ICs with lots of gates such as microprocessors and gate arrays, then the impedance of the power supply circuit can be important because the power supply system must be able to supply nearly instantaneous surges of current to feed the fast-switching gates of the ICs in which many gates may be required to switch at the same time. In such cases, even though a single gate may switch only 5 mA (for example), the total current demand for 1,000 gates that switch simultaneously would be 5 amps. Since it is desirable to have a very low voltage drop between the power source and the IC, the impedance of the power circuit must be very low. Even if the impedance of the power supply circuit were only 0.10 ohms, the voltage drop in this example would be 0.5 volts (5 amps times 0.1 ohm), which would be totally unacceptable in most applications. Thus, in designing power distribution systems for high speed digital data applications (printed circuit boards, cables, and connectors for example), it is desirable to make the characteristic impedance between the power line and its return path as low as possible in order to minimize the voltage drop. Making the impedance as low as possible requires using an insulating material with as high a relative dielectric constant as possible.

SUMMARY

The present invention is an insulator with air dielectric cavities for an electrical connector. The air dielectric cavities help reduce the effective dielectric constant of the materials used to construct the insulator. The reduction of the effective dielectric constant allows for the transmission of high-speed signals while maintaining impedance, thereby preserving signal fidelity. Air dielectric cavities are disposed in an alternating configuration between contact cavities. The contact cavities and air dielectric cavities can be arranged in rows where the spacing of each row is offset to reduce crosstalk. Data pair cavities and sideband cavities are separated to also reduce crosstalk.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
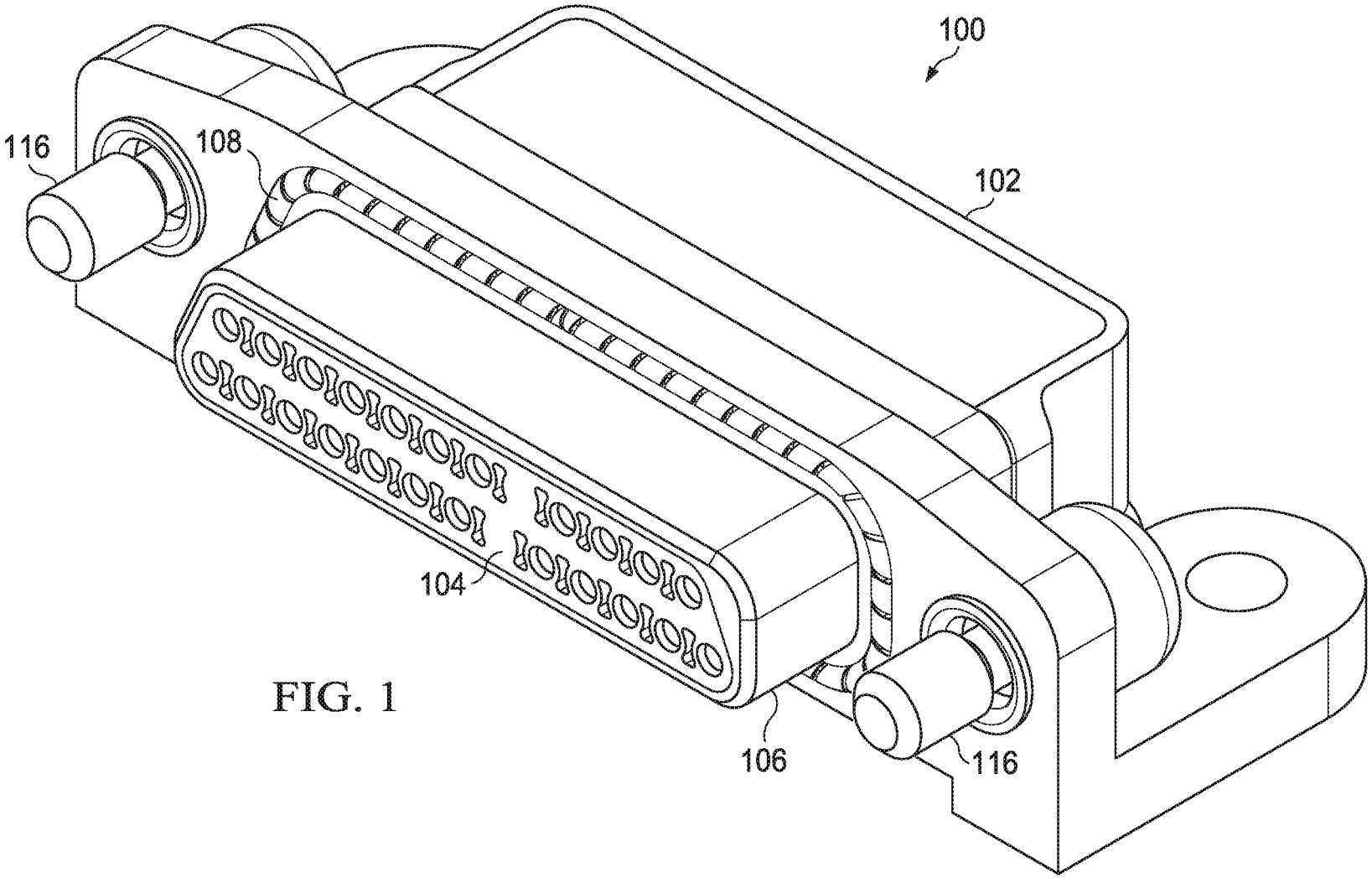
FIG. 1 is a top perspective view of an insulator with air passages installed on a right-angle male electrical connector.
Figure 5:
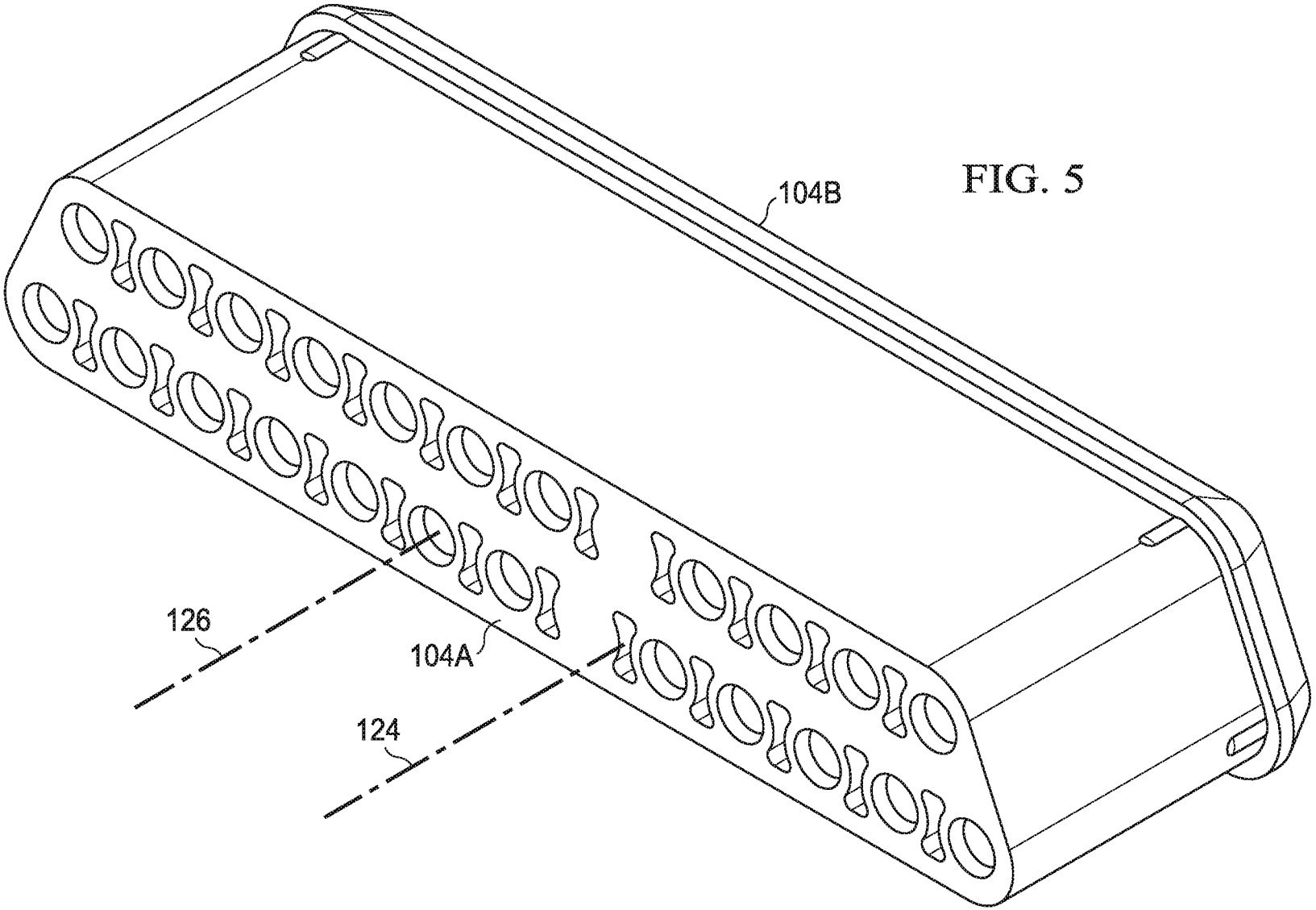
FIG. 5 is a top perspective view of an insulator with air passages showing the front face of the insulator with a longitudinal air cavity axis and a longitudinal data cavity axis passing through the insulator.
Figure 6:
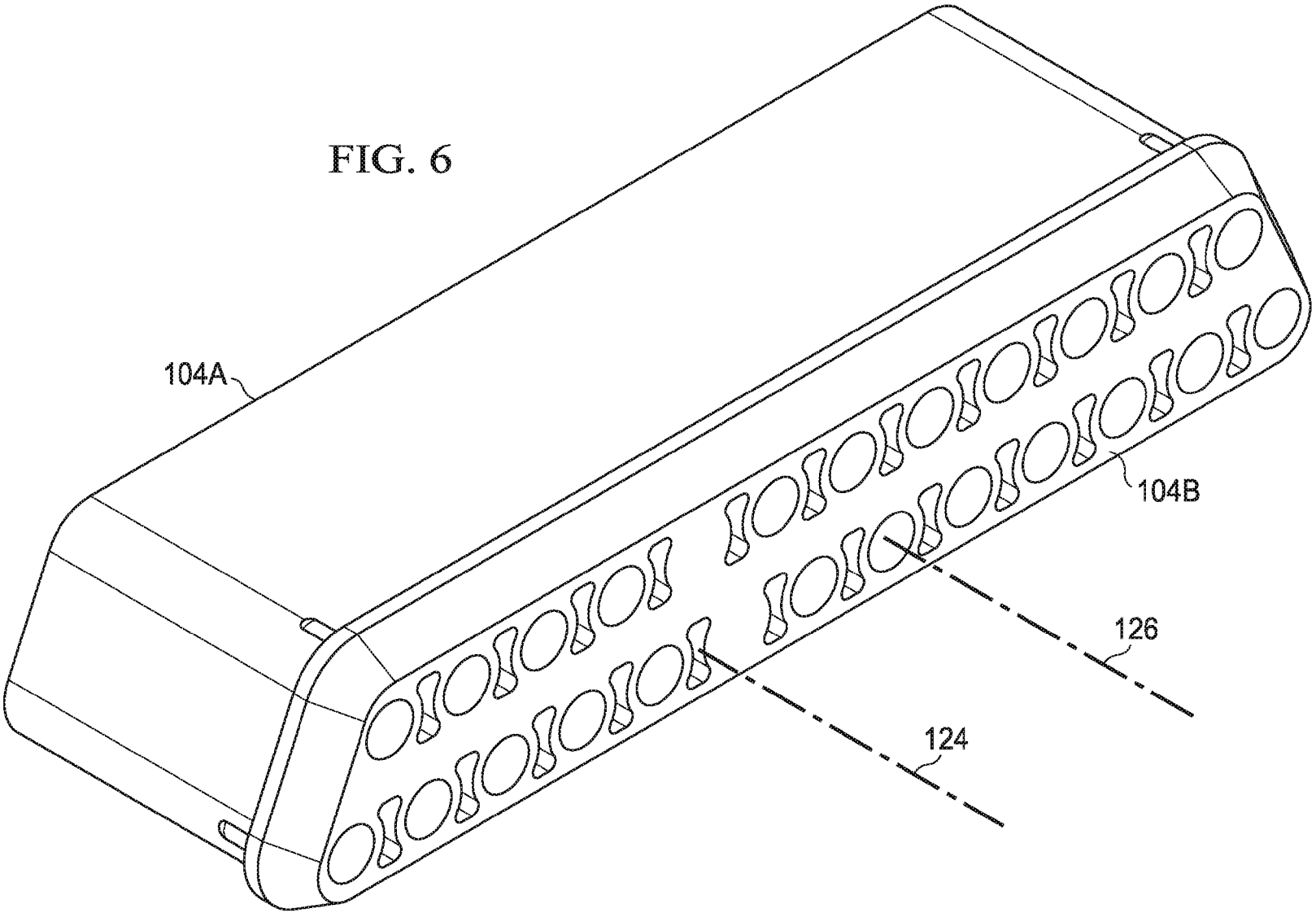
FIG. 6 is a top perspective view of an insulator with air passages showing the back face of the insulator with a longitudinal air cavity axis and a longitudinal data cavity axis passing through the insulator.
Figure 7:
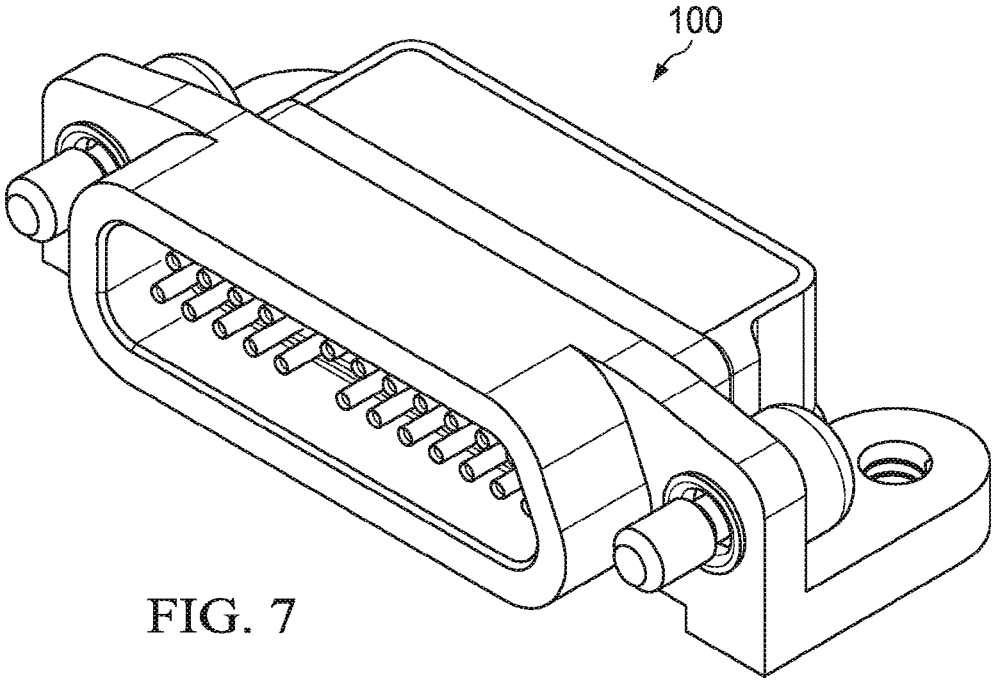
FIG. 7 is a top perspective view of an insulator with air passages installed on a right-angle female electrical connector.
Figure 8:
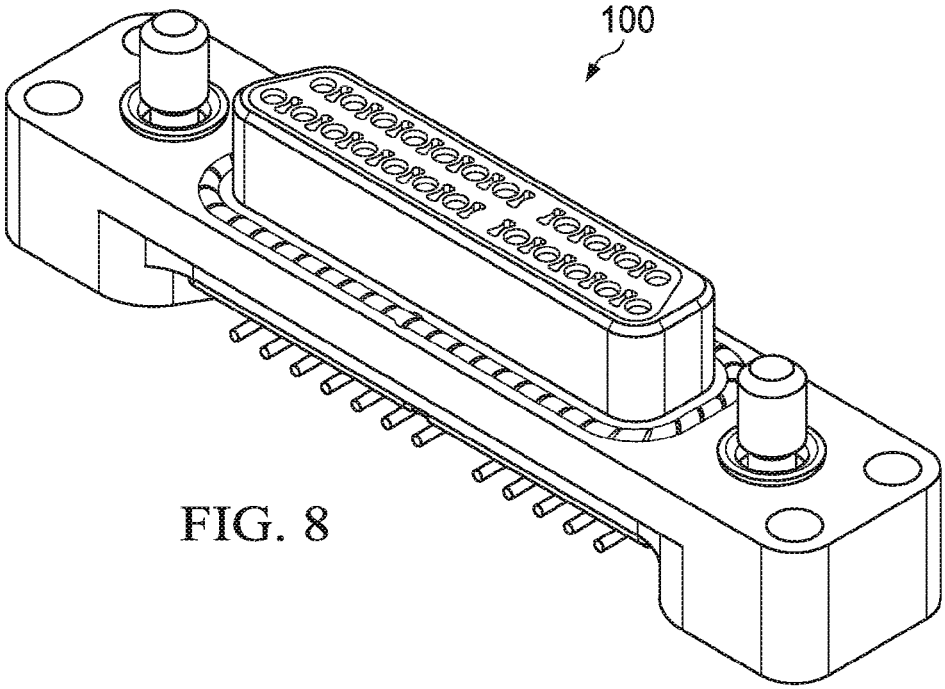
FIG. 8 is a top perspective view of an insulator with air passages installed on a vertical male electrical connector.

As shown in at least FIGS. 1 and 5-7, a connector 100 comprises a back shell 102, an insulator 104, a metal shell 106, and an electro-magnetic insulating ("EMI") band 108. Connector 100 can be either a male or female cable, vertical, right-angle, edge-mounted, or straddle-mounted connector. FIG. 1 depicts an example of a right-angle male connector. FIG. 7 depicts an example of a right-angle female connector. FIG. 8 depicts an example of a vertical male connector. As shown in FIG. 1, metal shell 106 is disposed within the front of back shell 102. Insulator 104 is desirably encased in metal shell 106. EMI band 108 is disposed on the front face of back shell 102 and traces the outside perimeter of metal shell 106. EMI band 108 provides insulation against electro-magnetic interference. Insulator 104 can be made of any suitable material for electrical connectors, preferably a durable plastic. As shown in FIGS. 5 and 6, insulator 104 has a front surface 104A and a back surface 104B.

Figure 2:
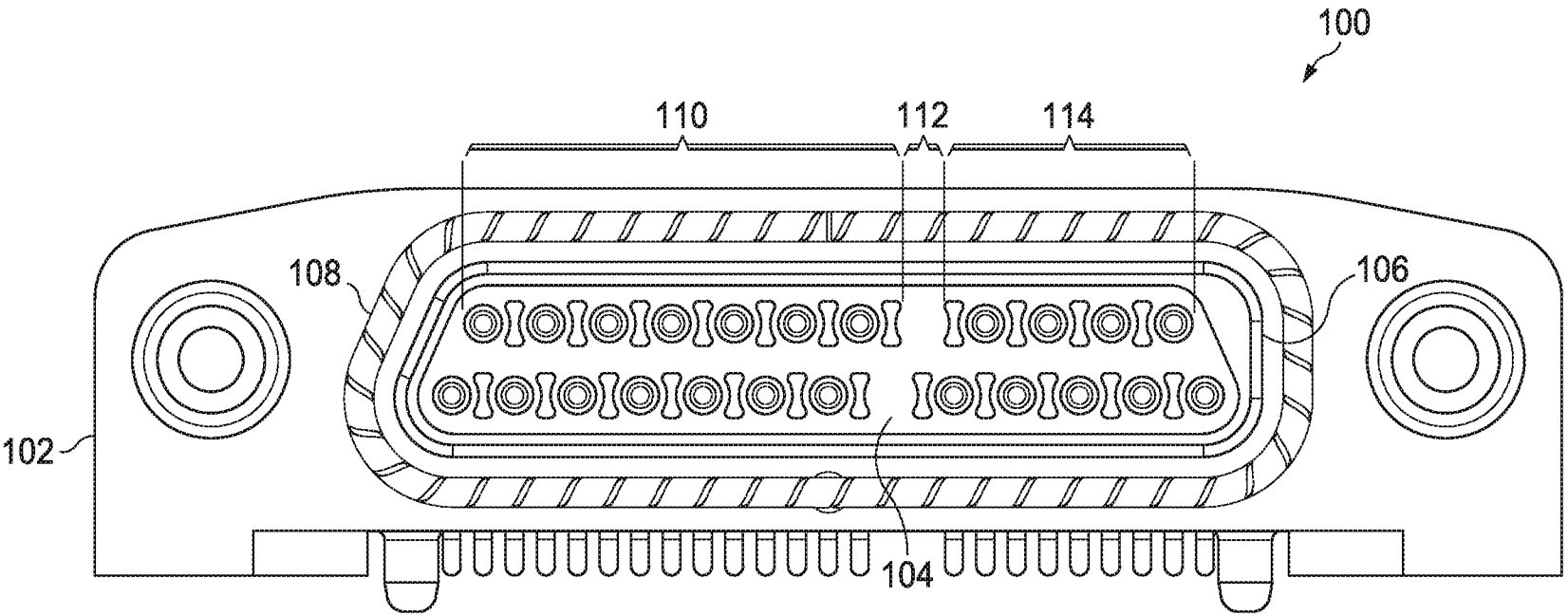
FIG. 2 is a front elevation view of an insulator with air passages installed on a right-angle male electrical connector.
Figure 3:
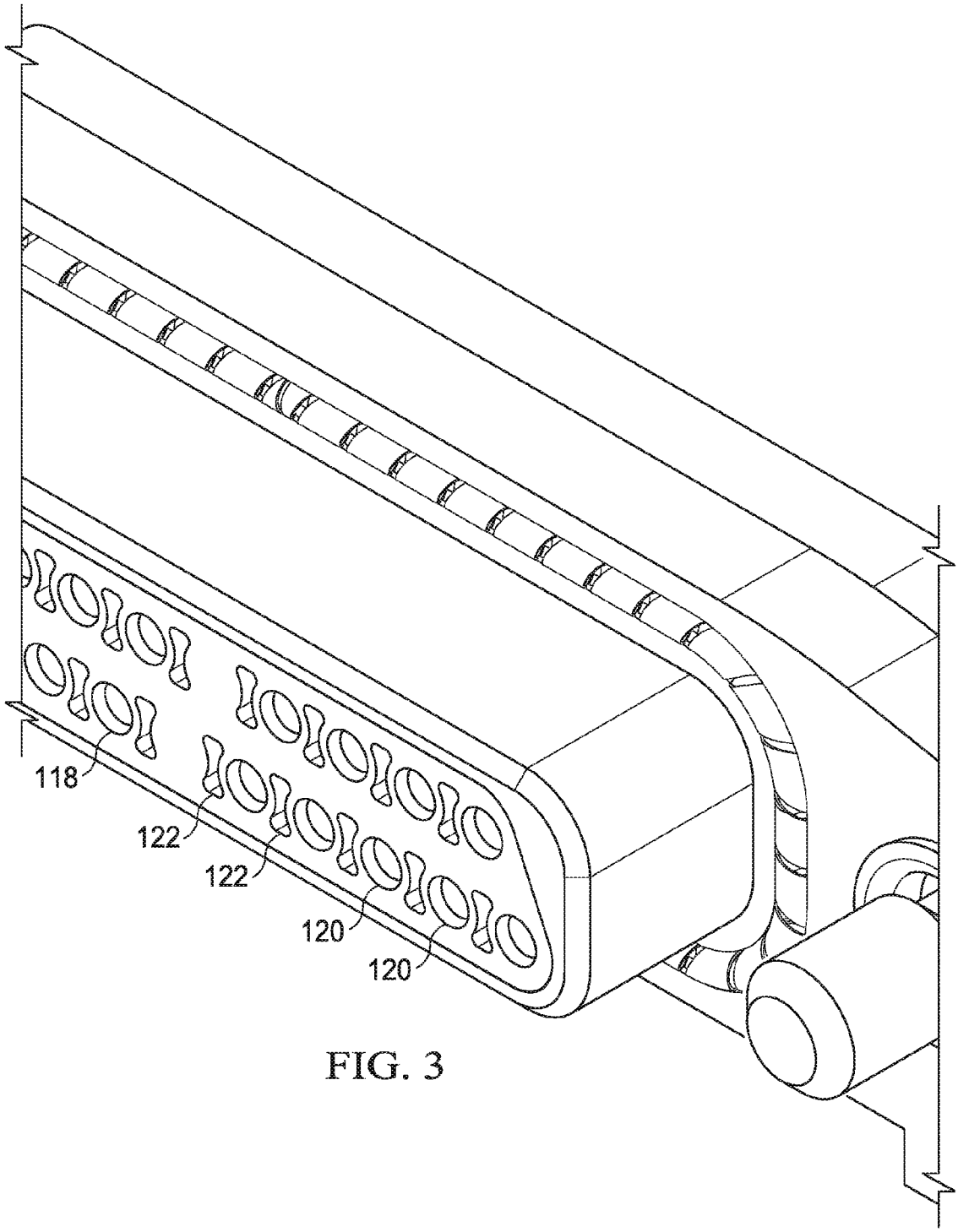
FIG. 3 is a close-up perspective view of sideband cavities and a separation channel on an insulator with air passages.

As shown in at least FIG. 2, insulator 104 features a plurality of data pair cavities 110 and a plurality of sideband cavities 114 and are separated by separation channel 112. The presence of separation channel 112 reduces crosstalk between data pair cavities 110 and sideband cavities 114 by providing physical separation between them. As shown in FIG. 3, data pair cavities 110 comprise a plurality of data pair contact cavities 118 and a plurality of air dielectric cavities 122. Sideband cavities 114 comprise a plurality of sideband contact cavities 120 and a plurality of air dielectric cavities 122.

As shown in FIGS. 1-4, data pair contact cavities 118 are arranged in an alternating configuration with air dielectric cavities 122. Similarly, sideband contact cavities 114 are arranged in an alternating configuration with air dielectric cavities 122. Data pair contact cavities 118, sideband contact cavities 114, and air dielectric cavities 122 all pass through insulator 104 from front surface 104A to back surface 104B.

In one preferred embodiment, data pair contact cavities 118 transmit high speed data, and sideband contact cavities 114 transmit low speed signals for channel identification or detection. Sideband contact cavities 114 can also be used for low power connectivity.

As shown in FIGS. 5 and 6, a longitudinal air cavity axis 124 runs through the length of each air dielectric cavity 122 while a longitudinal data cavity axis 126 runs through the length of each data pair contact cavity 118 and sideband contact cavity 120. Longitudinal air cavity axis 124 and longitudinal data cavity axis 126 run from front surface 104A to back surface 104B of insulator 104. In one preferred embodiment, longitudinal air cavity axis 124 is generally parallel to longitudinal data cavity axis 126. In such an embodiment, air dielectric cavities 122 are generally parallel to the axis of the data signal. The generally parallel arrangement of longitudinal air cavity axis 124 and longitudinal data cavity axis 126 minimizes impedance discontinuity and minimizes the degradation of signal fidelity and integrity while still lowering the effective dielectric constant. While a non-parallel arrangement of the axes can be used to lower the effective dielectric constant, non-parallel arrangements result in impedance discontinuity. Impedance discontinuity in turn results in the degradation of signal fidelity and integrity. For example, prior connectors disclose perpendicular arrangements of the axes of the data signal and air cavities. Such an arrangement results in very high and undesirable levels of signal interruption that are not suitable for high speed digital data transmission.

As shown in FIG. 1, fastening members 116 are disposed on either end of back shell 102 and work to secure connector 100 to a mating connector. Fastening members 116 can be thumb screws or jack screws.

As shown in FIGS. 1-4, in one embodiment the plurality of data pair cavities 110 and sideband cavities 114 are arranged into one or more rows. In this embodiment the row-to-row spacing is desirably larger than the pitch (spacing) between each data pair contact cavity 118 or sideband contact cavity 120. The rows are also offset by half of a pitch, which is half of the distance between each data pair contact cavity 118 or sideband contact cavity 120. This offset configuration results in a data pair contact cavity 118 or a sideband contact cavity 120 in one row to be vertically positioned above or below an air dielectric cavity 122. These spacing configurations work to isolate and reduced row-to-row crosstalk. Air dielectric cavities 122 are disposed between data pair contact cavities 118 or sideband contact cavities 120 such that either data pair contact cavities 118 or sideband contact cavities 120 alternate with air dielectric cavities 122.

Figure 4:
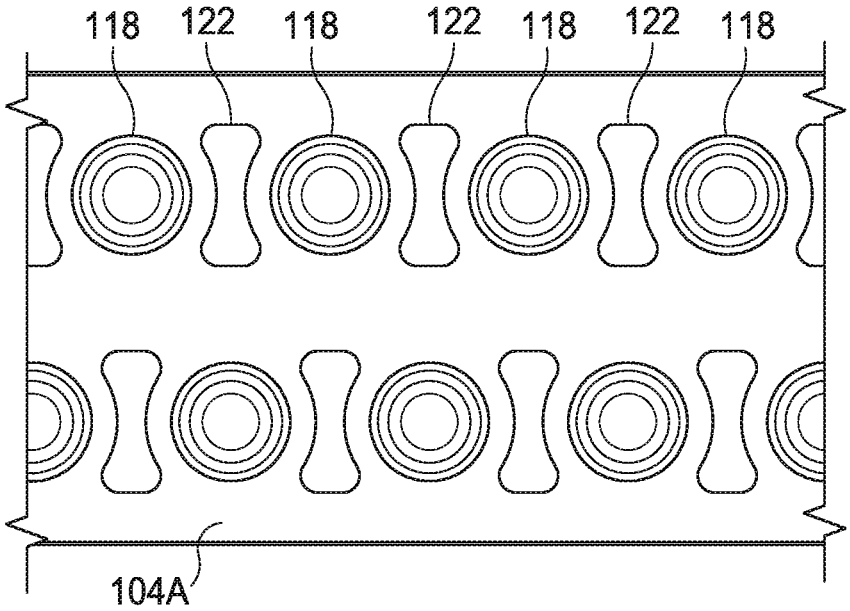
FIG. 4 is a close-up front elevation view of the configuration of the air dielectric and data pair cavities on an insulator.

Air dielectric cavities 122 can be of any shape that can be used for lowering the effective dielectric constant. The cross-sectional shape is taken in a plane perpendicular to the longitudinal air cavity axis 124. As shown in FIGS. 2 and 4, in one preferred embodiment, air dielectric cavities 122 have a cross-sectional shape that is a narrow, I-shaped (or dog-bone-shape) figure with concave sidewalls. This shape allows for a tighter contact cavity pitch, which supports a higher density of data pair cavities 110 and sideband cavities 114. This shape also provides a more structurally robust molded insulator. Similarly, data pair contact cavities 118 and sideband contact cavities 120 can be of any shape. In one preferred embodiment, data pair contact cavities 118 and sideband contact cavities 120 are circular or round-shaped.

The purpose of the air dielectric cavities 122 of the present invention is to reduce the effective dielectric constant of the material of insulator 104. Reducing the dielectric constant is desirable because the use of an insulating material with a lower dielectric constant allows the contacts which carry high-speed signals (differential or single ended) to be placed closer together while still maintaining the desired characteristic impedance (typically 100 ohms for differential signals and 50 ohms for single ended signals). For example, in one embodiment of the present invention, the addition of the air dielectric cavities 122 allows the spacing between the data pair contact cavities 118 or sideband contact cavities 120 to be reduced from approximately 0.100 to 0.070 inch while maintaining approximately a 100 ohm differential impedance. Without air dielectric cavities 122, placing the contact cavities on a pitch of 0.070 inch would have resulted in a characteristic impedance that was too low and would have caused a degradation in signal fidelity at high-speed data rates, such as those, for example, that are above 1 GB/s. The addition of the air cavities reduces the effective dielectric constant occurs as a result of the air having a "relative dielectric constant" of 1.0, and all other insulating materials have a relative dielectric constant that is greater than 1.0. The dielectric constant of most plastic connector insulator materials is in the range of 4.0. When there is more than one insulating material between the signal-carrying contacts, the "effective dielectric constant" of the insulating material between the contacts is to some extent a weighted average of the relative dielectric constants of these materials based on their relative volumes. For example, if 50% of the volume of material between the contacts is air, and 50% of the volume is plastic with a relative dielectric constant of 4.0, then the effective dielectric constant of the composite material will be approximately 2.5. Increasing the percentage of plastic would increase the effective dielectric constant, and increasing the percentage of air would decrease the effective dielectric constant.

Applicants claim:

1. An electrical high speed connector affording a reduction in the effective dielectric constant comprising:

an insulator body having a grouping of data pair cavities arranged adjacent to a grouping of sideband cavities, each data pair cavity and each sideband cavity having a first longitudinal axis, the insulator body further having air dielectric cavities, each air dielectric cavity having a second longitudinal axis;

said data pair cavities configured for carrying high speed data signals at a predefined data rate, said air dielectric cavities configured to minimize impedance discontinuity, and said sideband cavities configured for transmitting low speed signals for channel identification or detection or for use in low power connectivity;

wherein each data pair cavity is arranged adjacent to an air dielectric cavity in alternating fashion within the grouping of data pair cavities, the grouping of sideband cavities, and the date pair cavities, sideband cavities, and air dielectric cavities extend from a front surface of the insulator to a back surface of the insulator; and wherein said first longitudinal axis is generally parallel to second longitudinal axis.

2. The electrical high speed connector of claim 1 wherein the insulator is encased in a metal shell.

3. The electrical high speed connector of claim 1 wherein the insulator is contained within a right-angle electrical connector.

4. The electrical high speed connector of claim 1 wherein the insulator is contained within a vertical electrical connector.

5. The electrical high speed connector of claim 1 wherein the insulator is contained within an edge-mounted electrical connector.

6. The electrical high speed connector of claim 1 wherein the insulator is contained within a male electrical connector.

7. The electrical high speed connector of claim 1 wherein the insulator is contained within a female electrical connector.

8. The electrical high speed connector of claim 1 wherein the configuration of the data pair cavities and air dielectric cavities allows for a tighter pitch, higher density, and lighter weight.

9. The electrical high speed connector of claim 1 wherein the shape of the data pair cavities and air dielectric cavities allows for a tighter pitch, higher density, and lighter weight.

10. The electrical high speed connector of claim 1 wherein the at least one air dielectric cavity is I-shaped with concave side walls.

11. The electrical high speed connector of claim 1 wherein the at least one data pair cavity is round.

12. The electrical high speed connector of claim 1 wherein the insulator is surrounded by an EMI band.

13. The electrical high speed connector of claim 1 further comprising at least one sideband cavity separated from the at least one data pair cavity by a separation channel.

14. The electrical high speed connector of claim 1 wherein The insulator is disposed in a back shell.

15. The electrical high speed connector of claim 14 wherein the back shell further comprises fastening members.

16. The electrical high speed connector of claim 1 wherein the at least one air dielectric cavity and the at least one data pair cavity are arranged into a row of additional dielectric cavities and data pair cavities alternatingly spaced.

17. The electrical high speed connector of claim 16 further comprising a second row of alternating air dielectric cavities and data pair cavities.

18. The electrical high speed connector of claim 17 wherein the first row is offset from the second row in that the air dielectric cavities of the first row are disposed above the data pair cavities of the second row.

* * * * *

UNITED STATES PATENT AND TRADEMARK OFFICE

CERTIFICATE OF CORRECTION

PATENT NO. : 8,597,047 B2
APPLICATION NO. : 13/296174
DATED : December 3, 2013
INVENTOR(S) : Emad Soubh et al.

It is certified that error appears in the above-identified patent and that said Letters Patent is hereby corrected as shown below:

In the Claims

At column 4, line 60 of the '047 patent, please correct the patent by inserting after "data pair cavities,":

1. -- each sideband cavity is arranged adjacent to an air dielectric cavity in alternating fashion within --

Signed and Sealed this
First Day of April, 2014

Michelle K. Lee

Michelle K. Lee
*Deputy Director of the United States Patent and Trademark Office*